US005325755A

United States Patent [19]

Morita

[11] Patent Number: 5,325,755

[45] Date of Patent: Jul. 5, 1994

[54] PUNCH PRESS

[75] Inventor: Kyushin Morita, Ishikawa, Japan

[73] Assignee: Kabushiki Kaisha Komatsu Seisakusho, Japan

[21] Appl. No.: 927,520

[22] PCT Filed: Mar. 22, 1991

[86] PCT No.: PCT/JP91/00379

§ 371 Date: Sep. 17, 1992

§ 102(e) Date: Sep. 17, 1992

[87] PCT Pub. No.: WO91/14520

PCT Pub. Date: Oct. 3, 1991

[30] Foreign Application Priority Data

Mar. 23, 1990 [JP] Japan ..... 2-71925

[51] Int. Cl.[5] ..... B21D 28/36

[52] U.S. Cl. ..... 83/698.11; 83/559; 83/639.1

[58] Field of Search ..... 83/559, 639.1, 698, 83/552, 571

[56] References Cited

U.S. PATENT DOCUMENTS

| | | | |
|---|---|---|---|
| 3,495,493 | 2/1970 | Herb et al. | 83/698 |
| 3,548,700 | 12/1970 | Herzog | 83/698 |
| 3,762,264 | 10/1973 | Scott | 83/698 |
| 3,779,122 | 12/1973 | Sawvell | 83/698 |
| 4,206,667 | 6/1980 | Hirata et al. | 83/146 |
| 4,532,845 | 8/1985 | Jinnouchi | 83/552 |
| 4,624,165 | 11/1986 | Bredow et al. | 83/685 |
| 4,869,141 | 9/1989 | Klingel | 83/49 |

FOREIGN PATENT DOCUMENTS

| | | |
|---|---|---|
| 54-6751 | 3/1979 | Japan . |
| 54-17973 | 7/1979 | Japan . |
| 56-11926 | 9/1981 | Japan . |
| 59-44940 | 11/1984 | Japan . |
| 60-106630 | 6/1985 | Japan . |
| 60-106631 | 6/1985 | Japan . |
| 62-127318 | 8/1987 | Japan . |
| 63-130225 | 6/1988 | Japan . |
| 63-130226 | 6/1988 | Japan . |
| 63-130227 | 6/1988 | Japan . |
| 63-130228 | 6/1988 | Japan . |
| 64-3546 | 1/1989 | Japan . |
| 1148500 | 6/1989 | Japan . |
| 1228619 | 9/1989 | Japan . |
| 230334 | 1/1990 | Japan . |

*Primary Examiner*—Eugenia Jones
*Attorney, Agent, or Firm*—Ronald P. Kananen

[57] ABSTRACT

A punch press includes an upper main shaft (3) vertically movable by means of a hydraulic driving means ($2_1$, $2_2$, $3a$) and rotatable for indexing by means of a rotary driving means (7, 8, 9), a lower main shaft (30) positioned below the upper main shaft and rotatable in synchronism with the upper main shaft for indexing, upper and lower dies (23, 45) detachably mounted on the upper and lower main shafts in opposition to each other, and upper and lower clamping devices for clamping the upper and lower dies on the upper and lower main shafts (3, 30) with positioning in phase.

10 Claims, 5 Drawing Sheets

PUNCH PRESS

FIELD OF THE INVENTION

The present invention relates to a punch press operation for a punching and forming operation for a plate form work.

BACKGROUND ART OF THE INVENTION

Conventionally, a turret punch press is known as a device for punching and forming of plate form work. In this type of arrangement, a plurality of dies are required to be set in a turret prior to commencing operation.

A plurality of patent applications have been filed with respect to the various components of this type of device.

For example, Japanese Examined Patent Publication (Kokoku) No. 54-17973, Japanese Examined Patent Publication No. 54-6751, Japanese Unexamined Patent Publication (Kokai) No. 56-119626, Japanese Unexamined Patent Publication No. 60-106630 and Japanese Unexamined Patent Publication No. 60-106631 disclose technologies for positioning and exchanging of dies.

On the other hand, for example, Japanese Unexamined Patent Publication No. 63-130225, Japanese Unexamined Patent Publication No. 63-130226, Japanese Unexamined Patent Publication No. 63-130227, Japanese Unexamined Patent Publication No. 63-130228, Japanese Examined Utility Model Publication No. 64-3546, Japanese Unexamined Utility Model Publication No. 62-127318 and Japanese Examined Patent Publication No. 59-44940 disclose technologies for controlling strokes of upper dies or for rotating turrets.

All of these technologies relate to the turret punch press. The turret punch press includes upper and lower turrets which rotate in synchronism with each other. However, the construction which controls this synchronous rotation is complicated and expensive.

SUMMARY OF THE INVENTION

In view of the above mentioned drawback, it is an object of the present invention to provide a punch press which does not require a turret and an associated driving device, which has a simple construction can be easily handled, produced at low cost, and, in addition, exhibits highly reliable operation.

In order to accomplish the above-mentioned objects, a punch press, according to the first aspect of the invention, comprises:

an upper main shaft vertically movable by means of a hydraulic driving means and rotatable for indexing by a rotary driving means;

a lower main shaft positioned below the upper main shaft and rotatable in synchronism with the upper main shaft for indexing;

an upper die detachably mounted on the lower end of the upper main shaft and being automatically exchangeable;

a lower die detachably mounted on the upper end of the lower main shaft in opposition to the upper die and being automatically exchangeable;

an upper clamping device for clamping the upper die on the upper main shaft with positioning in phase; and a lower clamping device for clamping the lower die on the lower main shaft with positioning in phase.

According to the second aspect of the invention, there is provided a punch press as set forth in the first aspect, in which the lower main shaft is movable in a vertical direction by means of another hydraulic drive means.

According to the third aspect of the invention, there is provided a punch press as set forth in connection with the first aspect, in which the lowering speed and driving force for the upper main shaft are controlled by detecting the vertical position of the upper main shaft.

The advantages of the present invention having the construction as set forth above, are as follows. Namely, since punching can be performed between the upper which is mounted on the upper main shaft and which can be driven vertically by the hydraulic device, and the lower die which is mounted on the lower main shaft and which can be synchronously rotated with the upper main shaft, it becomes possible to perform the punching operation at an optimal speed depending upon the material, thickness and intended configuration by controlling the hydraulic pressure by detecting the position of the main shaft and thus enable high precision products to be obtained.

By providing necessary dies at the side of the automatic exchanging device, the dies mounted on the upper and lower main shafts can be automatically exchanged with other dies. Therefore, the upper and lower turrets, as required in the conventional type turret punch press, became unnecessary. Therefore, it becomes unnecessary to provide the complicated rotating mechanism at the side of the punch press to and thus enables the construction of the punch press to be simplified and the cost of the same to be reduced.

Furthermore, by controlling the lowering speed and the driving force of the upper main shaft with respect to the position indicative signal obtained by detecting the vertical position of the upper main shaft, an optimal punching condition with respect to the material, thickness and configuration to be punched can be obtained while achieving high precision. This technique also contributes to the lowering of noise produced during punching..

In addition, by setting rectangular or shaped dies on the upper and lower main shafts, and by performing punching with rotation of the main shaft for indexing in phase, complicated configurations can be easily punched. Therefore, in comparison with the conventional turret punch press, it becomes possible for a wide variety of jobs to be performed with a relatively small amount of apparatus and thus enable a significant increase in applicability.

The above-mentioned and other objects, aspects and advantages will become more clearly appreciated by those skilled in the art when the preferred embodiment consistent with the principle of the invention, is discussed with reference to the accompanying drawings.

DETAILED DESCRIPTION OF THE PREFERRED EMBODIMENT

The present invention will be discussed herebelow in detail in terms of the embodiment which is illustrated in the accompanying drawings.

Figure 1:
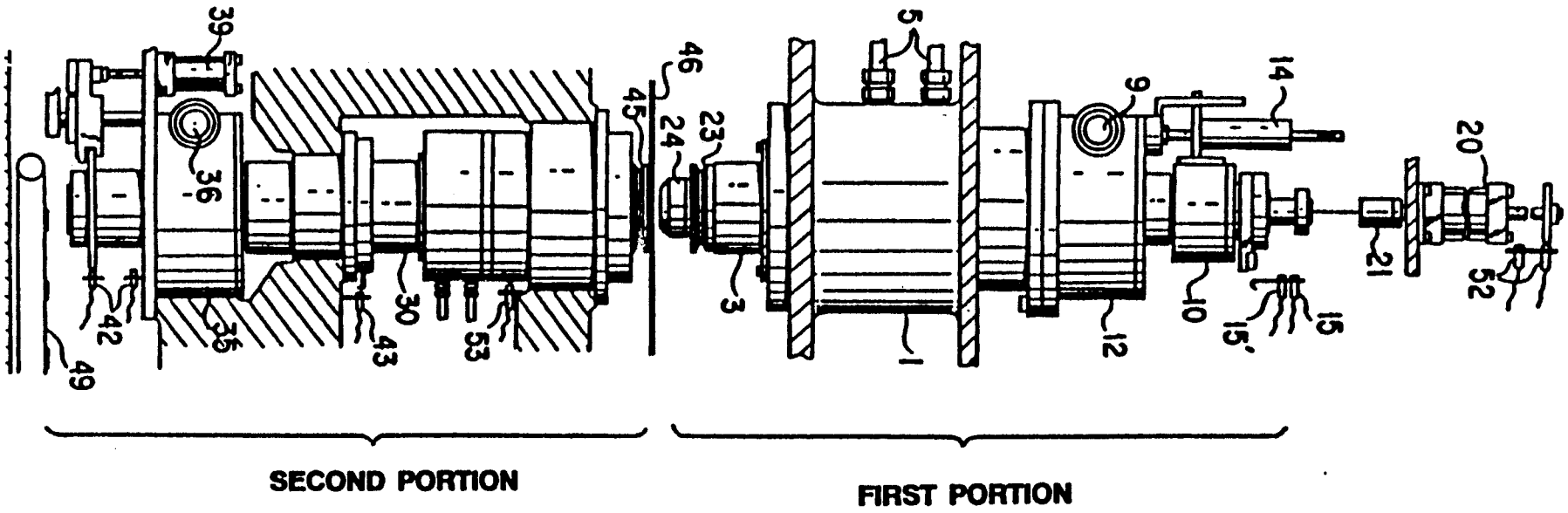
FIG. 1 is a fragmentary section showing the overall construction of one embodiment of the invention.
Figure 2:
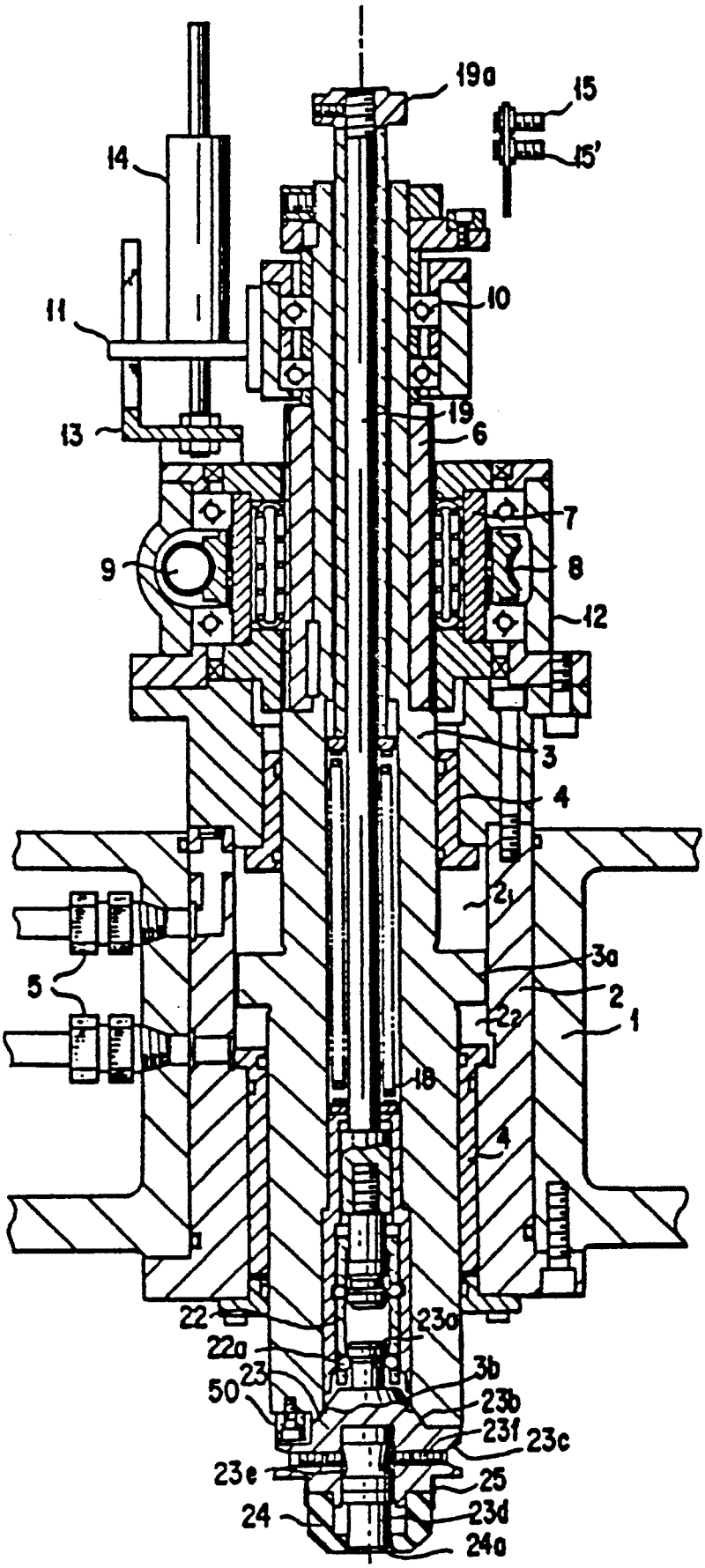
FIG. 2 is an enlarged section of the first portion in FIG. 1.
Figure 3:
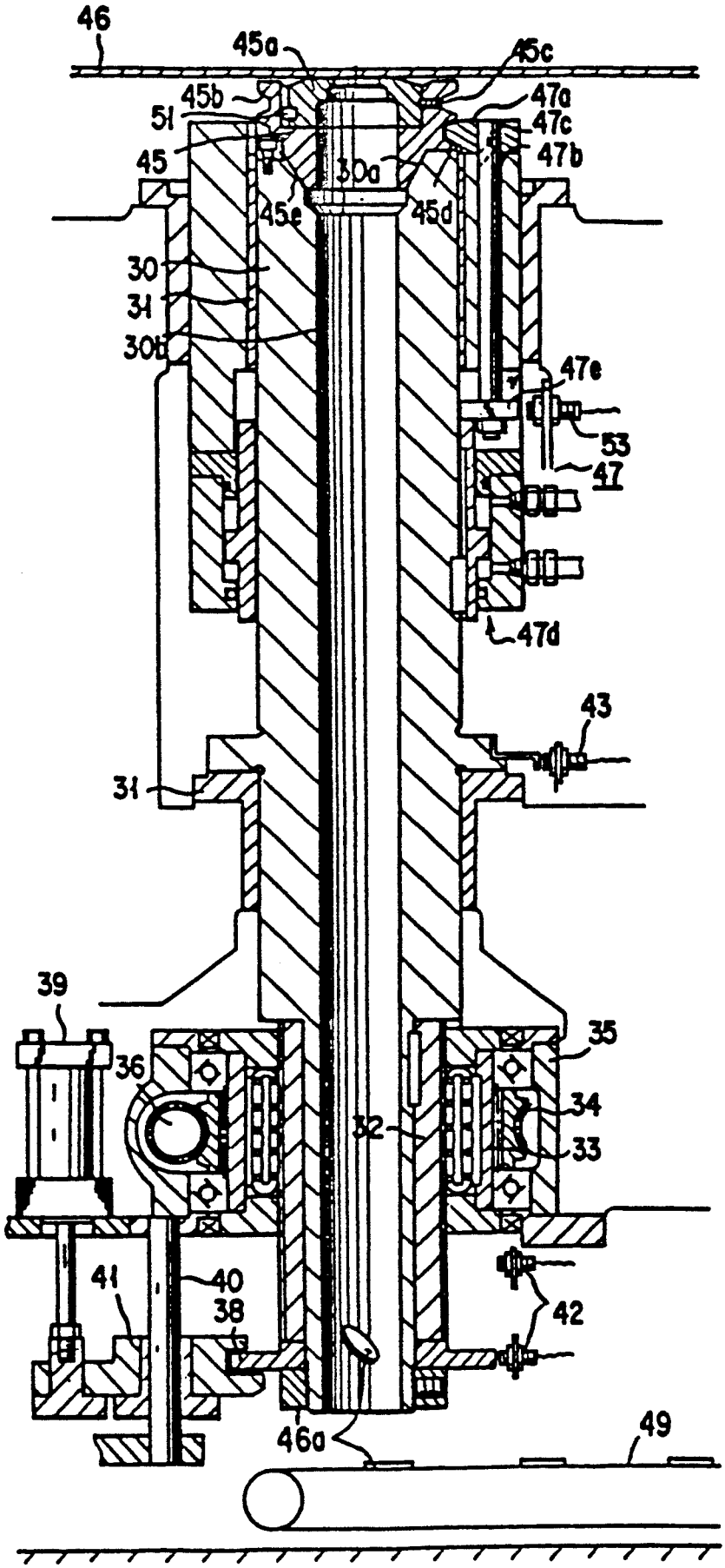
FIG. 3 is an enlarged section of the second portion in FIG. 1.
Figure 4:
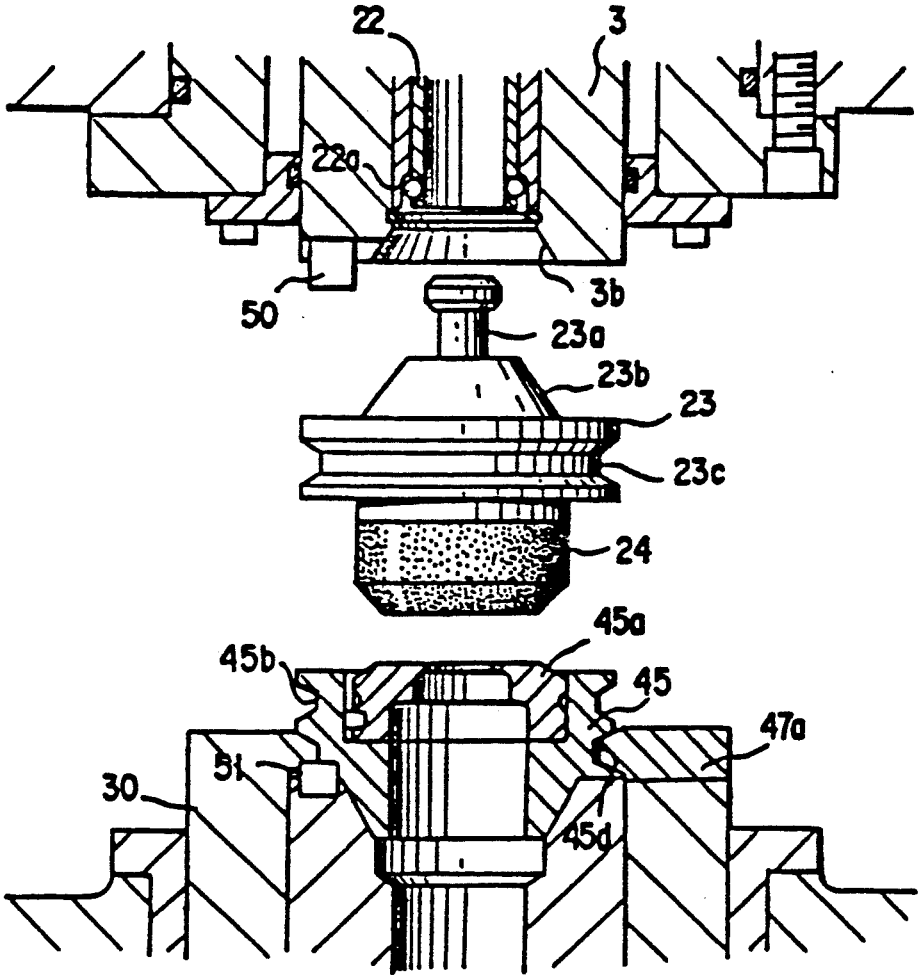
FIG. 4 and FIG. 5 are respectively explanatory illustrations showing operations which take place during automatic replacement of upper and lower die assemblies.
Figure 5:
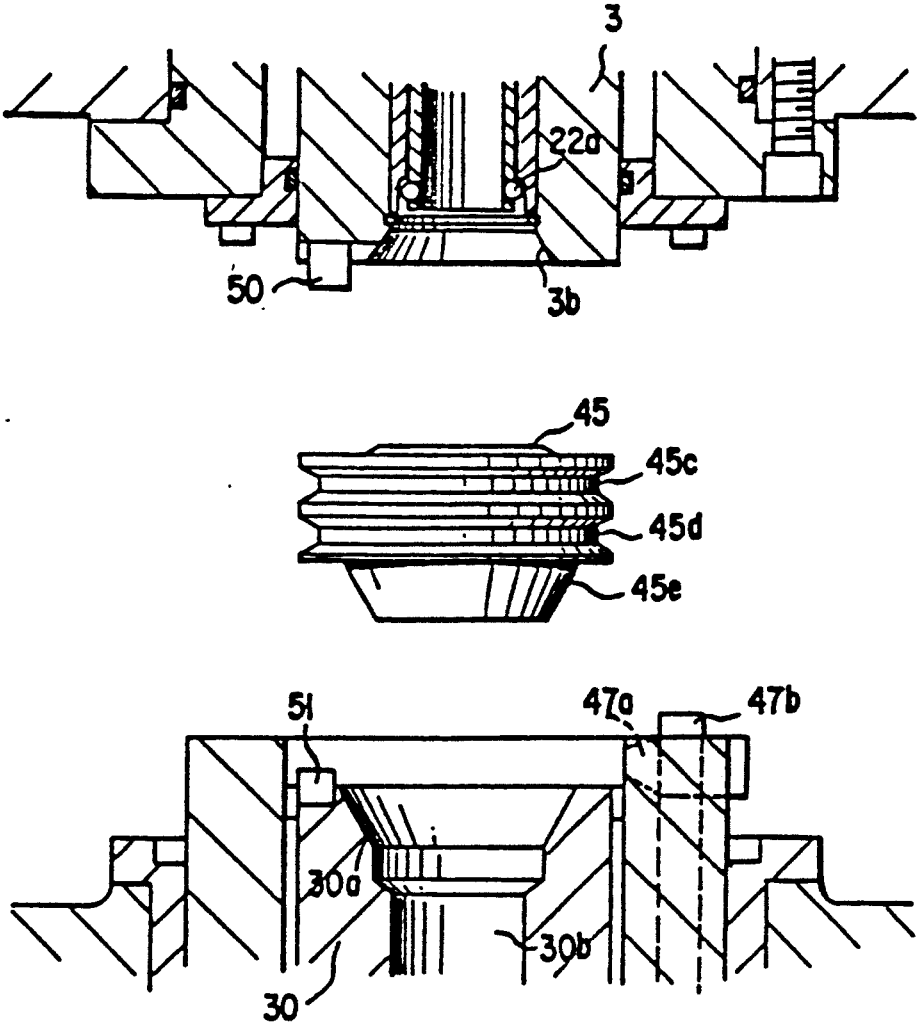

In FIGS. 1 through 3, the reference numeral 1 denotes a main body frame of a punch press. A cylinder 2 is fixedly mounted in the vertical direction of the main body frame 1. Within the cylinder 2, an upper main shaft 3 is vertically extended.

The upper main shaft 3 is formed into the following construction and supported on a sliding bearing 4 provided within the cylinder 2 for free rotation and vertical sliding movement. A hydraulic pressure chamber of the cylinder 2 is divided into an upper pressure chamber $2_1$ and a lower pressure chamber $2_2$ by a piston 3*a*, from which the main shaft 3 extends upwardly. The pressure chambers $2_1$ and $2_2$, are supplied with hydraulic pressure through a pressure supply pipe 5.

A spline shaft 6 is keyed to the upper portion of the upper main shaft 3 for rotation in unison. The spline shaft 6 is engaged with a worm wheel 8 a via ball spline nut 7.

The worm wheel 8 meshes with a worm 9 which is driven by rotary driving power source (not shown). Through this worm 9, the upper main shaft 3 can be displaced in the vertical direction and can be rotated.

Furthermore, an arm 11 is pivotally supported at the upper end of the upper main shaft 3 via a bearing 10.

A stroke sensor 14 for detecting the vertical stroke position of the upper main shaft 3 is provided between a tip end of the arm 11 and a bracket 13 which is fixed to a worm gear casing 12.

It should be noted that, in the drawings, 15 denotes a proximity switch for confirming the position of the upper main shaft 3 in the vertical direction, 15' denotes a proximity switch for detecting a reference point in the rotational direction of the upper main shaft 3.

A clamping rod 19 is disposed within the upper main shaft 3. The clamping rod 19 is biased upwardly by means of a compression spring 18.

A head 19*a* is mounted on the upper end of the clamping rod 19. The clamping rod 19 is adapted to be driven downwardly by a force applied to the head 19*a* by an unclamping cylinder 20 and a pusher 21.

The lower end of the clamping rod 19 is connected to a duel clamping mechanism 22 which is disposed within the interior space of the lower end portion of the upper main shaft 3.

Similarly to the clamp employed in a machining center, the die clamping mechanism 22 includes balls 22*a* which engage with a pull stud 23*a* of an upper die assembly 23. The pull stud 23*a* is inserted through the lower end of the upper main shaft 3. When the clamping rod 19 is moved upwardly under the influence of the compression spring 18, the taper portion 23*b* of the upper die assembly 23 is pressured onto a taper surface 3*b* formed at the lower end opening portion of the upper main shaft 3 so that the upper die assembly 23 can be mounted on the upper main shaft 3 in an aligned position.

The upper die assembly 23 is formed with an annular groove 23*c*, to which an arm of an unillustrated automatic exchanger device is engaged, so as to permit automatic exchange by means of the automatic exchanger device. A punch 23*d* is disposed within the upper die assembly 23. The punch 23*d* is fixed by fixing screws 23*f* threadingly inserted from the annular groove 23*c* at a taper portion 23*e*. The tip end of the punch 23*d* is extended toward an elastic stripper 24 which is detachably mounted on the lower end face of the upper die 23.

The elastic stripper 24 is made of an elastic body, such as a hard rubber or the like, and mounted on the lower end face of the upper die assembly 23 by means of a fixture 25. The elastic stripper 24 has a central hole 24*a*, through which the tip end of the punch 23*d* is extended.

In the drawings, 30 denotes a hollow lower main shaft provided beneath the upper main shaft 3. The lower main shaft 30 is supported on the main body frame 1 via a sliding bearing 31 for rotation and sliding vertical movement. Similarly to the upper main shaft 3, a spline shaft 32 is keyed to the lower end portion of the lower main shaft 30. A worm wheel 34 is engaged to the spline shaft 32 via a ball spline nut 33 so that the spline shaft 32 can be driven to rotate by a worm 36 disposed in a worm casing 35 via said worm wheel 34.

On the other hand, a ring 38 is fixed to the lower end of the lower main shaft 30. A yoke 41 is engaged on the outer periphery of the ring 38. The yoke 40 is supported by a lift cylinder 39 for vertical movement along a guide rod 40. Therefore, the lower main shaft 30 can be driven vertically by the lift cylinder 39.

It should be noted that, in the drawings, 42 denotes a proximity switch for confirming the vertical position of the lower main shaft 30, while 43 denotes a proximity switch for detecting the reference position of the lower main shaft 30 in the rotational direction thereof.

A lower die assembly 45 is mounted on the upper end of the lower main shaft 30.

The die 45*a* is provided on the lower die assembly 45 for punching a work piece 46 between the punch 23*d* of the upper die assembly 23.

The die 45*a* is detachably fixed to the lower die assembly 45 by fastening screws 45*c* which are threadingly inserted from an annular groove 45*b*, to which an arm of unillustrated automatic exchanger device is engaged. A clamping groove 45*d* is formed below the annular groove 45*b*. A plurality of clamping claws 47*a* arranged in the circumferential direction are releasably engaged in the clamping groove 45*d*.

The clamping claws 47*a* are engaged to a wedge shaped portion 47*c* provided at the upper end of a clamping rod 47*b* so that they may move toward and away from the clamping groove 45*d* in accordance with the vertical movement of the clamping rod 47*b*. The lower end of the clamping rod 47*b* is fixed to a ring 47*e* which is driven in vertical direction along the lower main shaft 30 by a clamping cylinder 47*d*.

By pushing the clamping rod 47*b* up using clamping cylinder 47*d* and ring 47*e*, the clamping claws 47*a* enter into the clamping groove 45*d* so that the taper portion 45*e* formed on the lower die assembly 45 is pressed onto a taper surface 30*a* formed on the upper end opening of the lower main shaft 30.

It should be noted that, in the drawings, 50 denotes a phase positioning key for positioning the upper die assembly 23 in the rotating direction, while 51 is a phase positioning key for positioning the lower die assembly 45 in the rotating direction.

Also, in the drawings, 52 and 53 denote proximity switches for confirming operational positions of the clamping cylinders 20 and 47*d*.

Next, the operation will be discussed with reference to FIGS. 2 and 3. FIG. 1 shows the condition before punching the work piece 46 between the punch 23*d* provided in the upper die assembly 23 and the die 45*a* provided in the lower die assembly 45. When the hydraulic pressure is supplied to the upper pressure chamber $2_1$, the upper main shaft 3 is lowered from the illustrated position so as to initially bring the elastic stripper 24 onto the upper surface of the work 26. Further downward movement of the upper main shaft 3, compresses the elastic stripper 24 and the work 46 is punched between the punch 23*d* and the die 45*a*.

Subsequently, by supplying hydraulic pressure to the lower pressure chamber $2_2$, the upper main shaft 3 is driven upwardly. Upon the upward movement of the upper main shaft 3, the elastic stripper 24 returns to its original shape and the punch 23*d* is withdrawn from engaging the work piece 46. A punched piece 46*a* punched from the work 46 drops through the hollow hole 30*b* of the lower main shaft 30 to reach a transporting device 49, such as a conveyor and is removed.

By repeating the foregoing operation, punching of the work piece 46 can be sequentially carried out. When a phase of a shaped die is to be changed, the upper and lower main shafts 3 and 30 are driven to rotate in synchronism with each other by the rotary driving power source via the worms 9 and 36 and the worm wheels 8 and 34.

By this, punching by the shaped die with a change phase can be done easily. Also, it becomes possible to perform punching of complicated configurations by sequential phase division.

Discussion will be given herebelow with respect to exchanging of the upper and lower dies 23 and 45. At first, the piston 3*a* in the cylinder 2 is positioned at a substantially intermediate position in the cylinder 2 as shown in FIG. 1. At this time, the arm of a non-illustrated automatic exchanger device is moved toward the upper die 23 and grips the annular groove 23*c* of the die 23.

Once, the upper die 23 is gripped, the pusher 21 is driven downwardly by the unclamping cylinder 20 to apply pressure to the head 19*a* at the top end of the clamping rod 19 to release the die clamping mechanism 22.

Then, while in this position, the upper die 23 can be detached from the upper main shaft 3, as shown in FIG. 2.

On the other hand, when the detaching of the upper die 23 is completed, the lower main shaft 30 is driven upwardly by the lift cylinder 39. Thereafter, the clamp rod 47*b* is driven downwardly by the clamping cylinder 47 of the die clamping mechanism 47 to release the lower die 45 via retraction of the clamping claws 47*a*.

Then, under these conditions, the arm of the unillustrated automatic exchanger device grips the lower die 45. Once the arm grips the lower die, the lower die 45 is detached from the lower main shaft 30 by lowering the lower main shaft 30, in the manner shown in FIG. 3.

Once, removal of the upper and lower dies 23 and 45 is completed, the arm of the unillustrated automatic exchanger device is pivoted so that the next upper and lower dies which are gripped by the arm approach the upper and lower main shafts 3 and 30 in turn attachment of the next dies can be carried out by reversing the detachment procedure. Through this technique dies can be automatically replaced with the next required dies.

The positioning of the upper and lower dies which are newly attached to the respective of the upper and lower shafts 3 and 30, in phase direction relative to the main shafts 3 and 30 can be done with high accuracy through the phase positioning keys 50 and 51.

I claim:

1. A punch press comprising:

an upper assembly including an upper main shaft having a lower end detachably mounting an upper die, said upper assembly including an upper clamping means for automatically clamping and unclamping said upper die by an action in an axial direction of said upper main shaft;

a lower assembly including a lower main shaft having an upper end detachably mounting a lower die, said lower assembly further including a lower clamping means for releasably clamping said lower die on the upper end of said lower main shaft; and an angular phase adjusting means for adjusting angular phases of said upper and lower dies to a predetermined phase relationship relative to each other;

wherein said upper clamping means includes an axially movable member extending coaxially within said upper main shaft, a clamping mechanism mounted to a lower end of said axially movable member, a mechanical spring means for normally biasing and axially movable member in an upward direction to provide a clamping force for clamping said upper die, and a means for moving said axially movable member and said clamping mechanism in a downward direction against the bias of said mechanical spring means to an unclamping position for unclamping said upper die.

2. A punch press as set forth in claim 1, wherein said clamping mechanism of said upper clamping means comprises means for engaging a pull stud of said upper die while said clamping force is provided by said mechanical spring means.

3. A punch press as set forth in claim 2, wherein said means for moving said axially movable member of said upper clamping means comprises a hydraulic cylinder for axially driving said movable member downwardly against the bias of said mechanical spring means to thereby release said clamping force.

4. A punch press as set forth in claim 2, wherein said lower clamping means automatically clamps and unclamps said lower die by an action in an axial direction of said upper main shaft.

5. A punch press as set forth in claim 4, wherein said lower clamping means comprises a clamping claw radially movable between a clamping position and an unclamping position relative to said lower die, and means movable in an axial direction of said lower shaft for operating said clamping claw between said clamping position and said unclamping position.

6. A punch press as set forth in claim 5, wherein said lower clamping means further comprises a hydraulic cylinder for driving said movable means in said axial direction for operating said clamping claw between said clamping position and said unclamping position.

7. A punch press as set forth in claim 1, wherein said lower clamping means automatically clamps and unclamps said lower die by an action in an axial direction of said upper main shaft.

8. A punch press as set forth in claim 7, wherein said lower clamping means comprises a clamping claw radially movable between a clamping position and an unclamping position relative to said lower die, and means movable in an axial direction of said lower shaft for operating said clamping claw between said clamping position and said unclamping position.

9. A punch press as set forth in claim 8, wherein said lower clamping means further comprises a hydraulic cylinder for driving said movable means in said axial direction for operating said clamping claw between said clamping position and said unclamping position.

10. A punch press as set forth in claim 1, wherein each of said upper and lower dies engages with the corresponding one of said upper and lower main shafts in self-alignment by taper engagement. n

* * * * *